United States Patent [19]

Rowley

[11] 4,444,544

[45] Apr. 24, 1984

[54] LOCKING OF ROTOR BLADES ON A ROTOR DISK

[75] Inventor: Robert L. Rowley, Glastonbury, Conn.

[73] Assignee: United Technologies Corporation, Hartford, Conn.

[21] Appl. No.: 218,240

[22] Filed: Dec. 19, 1980

[51] Int. Cl.[3] ..... F01D 5/32

[52] U.S. Cl. ..... 416/221; 416/218

[58] Field of Search ..... 416/221, 220 R, 218; 403/316, 317, 319, 355, 356, 358, 381, 359, 323, 324, 331

[56] References Cited

U.S. PATENT DOCUMENTS

| | | | |
|---|---|---|---|
| 1,072,457 | 9/1913 | Herr | 416/221 |
| 2,713,991 | 7/1955 | Secord et al. | 416/221 |
| 2,755,062 | 7/1956 | Hill | 416/221 |
| 2,942,842 | 6/1960 | Hayes | 416/221 |
| 2,994,507 | 8/1961 | Keller et al. | 416/221 |
| 3,656,865 | 4/1972 | Spears, Jr. | 416/221 |
| 3,807,898 | 4/1974 | Guy et al. | 416/220 R |

FOREIGN PATENT DOCUMENTS

| | | | |
|---|---|---|---|
| 1037572 | 9/1953 | France . | |
| 1128113 | 1/1957 | France | 416/221 |
| 948722 | 2/1964 | United Kingdom . | |

*Primary Examiner*—L. J. Casaregola
*Assistant Examiner*—Jeffrey A. Simenauer
*Attorney, Agent, or Firm*—Gene D. Fleischhauer

[57] ABSTRACT

A rotor stage assembly 20 of the type adapted for use in an axial flow gas turbine engine is disclosed. The assembly includes a rotor disk 36 having blade attachment slots 42 configured to receive a plurality of rotor blades 40. Each rotor blade is insertable into the disk in a generally axial direction. Each rotor blade is retained against fore and aft movement by a lock pin 52. The disk is adapted by a groove 44 and the blade is adapted by a groove 48 to receive the lock pin. During assembly the lock pin is slidable in the grooves 44,48 to bring the lock pin into engagement with the corresponding groove in a rotor blade in a corresponding groove in the disk.

3 Claims, 4 Drawing Figures

LOCKING OF ROTOR BLADES ON A ROTOR DISK

DESCRIPTION

1. Technical Field

This invention relates to axial flow rotary machines and more particularly to the use of a locking device to retain a rotor blade on a rotor disk.

The concepts were developed in the gas turbine engine industry for locking compressor and turbine blades to the rotors of such engines, but have wider applicability to similarly configured assemblies.

2. Background Art

In the gas turbine engine field, rotor assemblies are typically formed of axially adjacent rotor disks from which pluralities of blades extend radially across the path of working medium gases flowing through the engine. An example of such a bladed rotor stage assembly is shown in U.S. Pat. No. 3,807,898 entitled "Bladed Rotor Assemblies" issued to Guy et al. In this assembly, a plurality of sealing plates extend from the rotor disk to each rotor blade platform to lock the blades in place in the fore and aft direction and to block leakage between the platforms and the disk. Another locking device is illustrated in U.S. Pat. No. 2,713,991 entitled "Rotor Blade Locking Device" issued to Secord et al. In this construction, the locking device is a circumferentially extending cylinder. The rotor blade has an L-shaped lip which engages the cylinder such that the cylinder presents two shearing planes in the wire to resist movement of the blade in a generally axial direction. These shearing planes are transversely oriented to the longitudinal axis of the cylinder.

Notwithstanding the availability of the above locking devices, scientists and engineers continue to seek improved locking devices which are light in weight and which block the leakage of working medium gases between the rotor blade and the rotor disk.

DISCLOSURE OF INVENTION

According to the present invention, a pin disposed in a lateral direction across a rotor blade root between the base of the blade root and a supporting disk engages a groove on the base of the root and a corresponding groove at the periphery of the disk to trap the blade on the disk and to block the leakage of working medium gases across the disk between the base of the blade root and the disk.

A primary feature of the present invention is a rotor disk adapted by blade attachment slots to receive rotor blades. The rotor disk has a groove extending in a lateral direction across the blade attachment slot. The groove faces in a generally outward direction. The rotor blade has a base facing in a generally inward direction. The rotor blade has a groove extending in a lateral direction across the base of the blade in alignment with and facing the groove in the disk. Another feature is a lock pin engaging the rotor disk and the rotor blade at the disk groove and the blade groove. In one embodiment a radial projection on the rotor blade bounds the groove in the base of the rotor blade.

A primary advantage of the present invention is the small size of the blade lock which is enabled by resisting fore and aft movement of the rotor blade along a laterally extending shear section through the lock as compared with blade locks resisting movement of the blade along shear planes extending in a transverse direction.

Another advantage is the engine efficiency which results from blocking the leakage of working medium gases across the rotor disk between the root of the rotor blade and the disk with each lock pin. Another advantage is the low level of blade root stresses, which is attributable to the lateral engagement of the blade root at the blade/disk interface. The ease of assembly is enhanced by retaining the blade against movement in the fore and aft direction with a lock pin which is completely accessible from one side of the disk. The ease of disassembly is enhanced by enabling the removal of a single rotor blade from the disk groove by withdrawing a single lock pin.

The foregoing and other objects, features and advantages of the present invention will become more apparent in the light of the following detailed dscription of the preferred embodiment thereof as shown in the accompanying drawing.

BEST MODE FOR CARRYING OUT THE INVENTION

Figure 1:
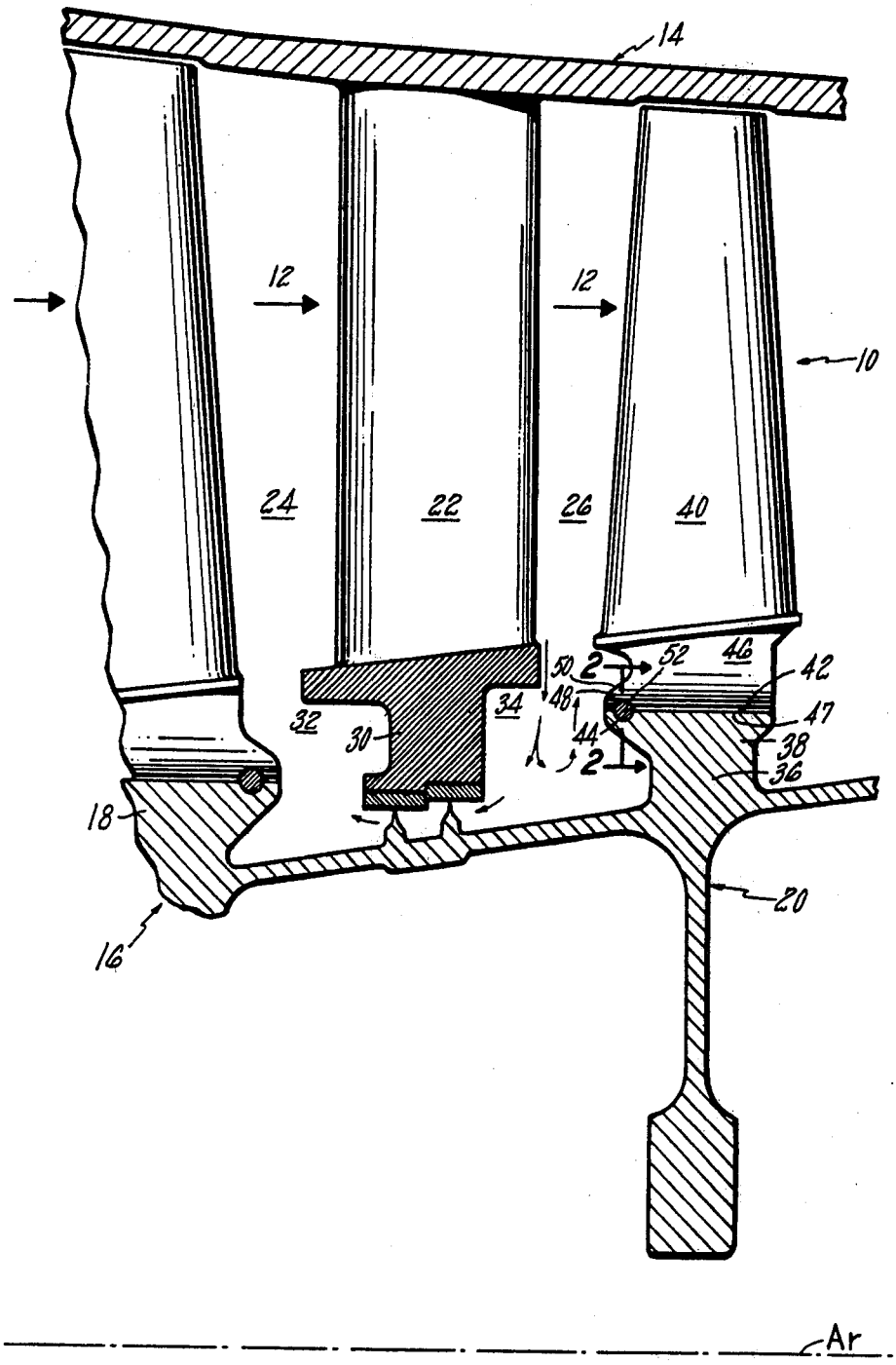
FIG. 1 is a cross-sectional view of a portion of a compressor section of a gas turbine engine employing the concepts of the present invention.

The concepts of the present invention are illustrated in the compressor of a gas turbine engine. FIG. 1 shows a portion of a compressor 10. A flow path 12 for working medium gases extends axially through the compressor. The compressor includes a stator assembly 14 and a rotor assembly 16. The rotor assembly has an axis of rotation Ar and includes an upstream rotor stage 18 and a downstream rotor stage 20. The downstream rotor stage is spaced axially from the upstream rotor stage leaving between these stages both an axial portion of the flow path and a cavity inwardly of the flow path. The stator assembly includes an array of stator vanes 22 extending across the flow path to divide the axial portion of the flow path into an upstream region 24 having a first pressure and a downstream region 26 having a pressure higher than the first pressure. A shroud 30 engages the tip region of each vane and extends circumferentially to divide the cavity between the rotor stages into an upstream cavity 32 and a downstream cavity 34. The upstream cavity is in fluid communication with the downstream cavity.

The downstream rotor stage 20 includes a disk 36 having a periphery such as the rim section 38 which extends circumferentially about the disk. The rotor assembly includes a plurality of rotor blades such as the single rotor blade 40 extending outwardly across the working medium flow path. The rim section 38 is adapted to receive the rotor blades by a plurality of blade attachment slots as represented by the single blade attachment slot 42. These slots extend in a generally axial direction. The periphery of the rotor disk has a groove 44 extending in a generally circumferential (lateral) direction across each attachment slot and facing in a generally outward direction. Each rotor blade has a root 46 which is adapted to conform to a corresponding blade attachment slot. The base 47 of the root has a groove 48. The groove in the root is oriented to face the groove in the disk and to be in radial alignment with the groove in the disk when the blade is in the installed condition. A radial projection 50 on the root extends both axially and radially to bound the groove in the blade and is adjacent to the working medium gases in the high pressure downstream cavity 34. A lock pin 52 extending both in the disk groove and in a corresponding blade groove engages the disk and the blade.

Figure 2:
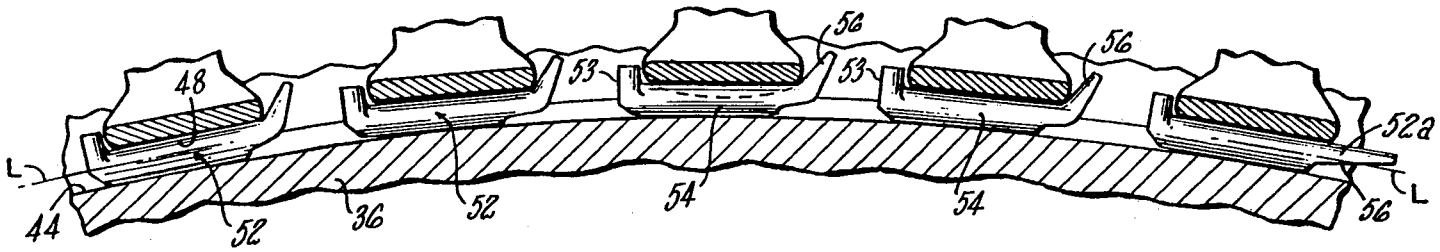
FIG. 2 is a sectional view along the lines 2—2 of FIG. 1.

FIG. 2 is an enlarged sectional view taken along the lines 2—2 of FIG. 1 and shows four lock pins 52 in the assembled condition and one lock pin 52*a* during assembly. Each pin has a longitudinal axis L. The pin extends laterally in the circumferential groove 44 of the disk 36. Each pin has a first end portion 53, a center portion 54 and a thinned second end portion 56. The first end portion has an L-shaped profile. The center portion comprises a right circular cylinder. The thinned end portion includes a truncated right circular cylinder having a cross-sectional thickness which decreases constantly to the second end of the lock. The thinned end portion is bendable without fracture in a direction perpendicular to the longitudinal axis L of the center section.

Figure 3:
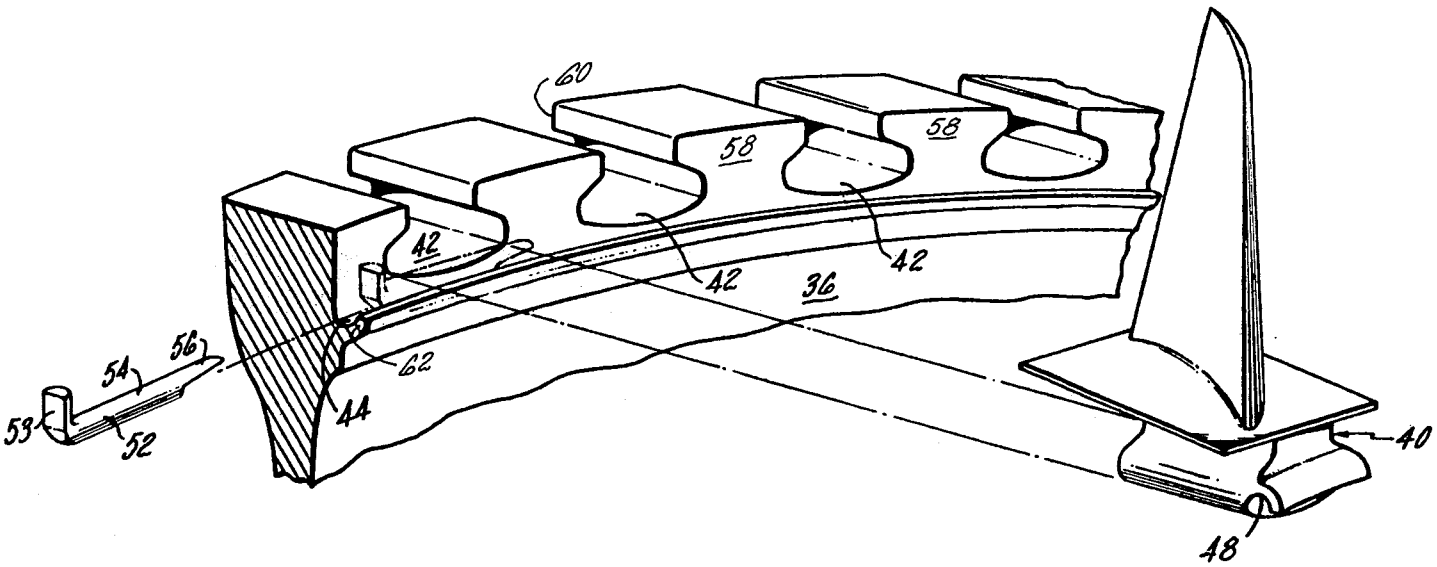
FIG. 3 is an exploded partial perspective view of a rotor stage assembly of FIG. 1.

FIG. 3 is an exploded partial perspective view of a rotor disk 36, a rotor blade 40 and a lock pin 52. The disk has an upstream side 58 and a downstream side 60. Each slot 42 extends between the sides of the disk. A projection 62 extends from the upstream side of the disk. The groove 44 of the disk extends in a lateral direction across each blade attachment slot 42 and is bounded by the projection and the upstream side of the disk. The phantom lines show the relationship of the lock pin to the groove 44 of the disk and the blade attachment slot 42 of the disk with the rotor blade removed for clarity. As will be realized, the rotor blade 40 is assembled to the disk before insertion of the lock pin.

Figure 4:
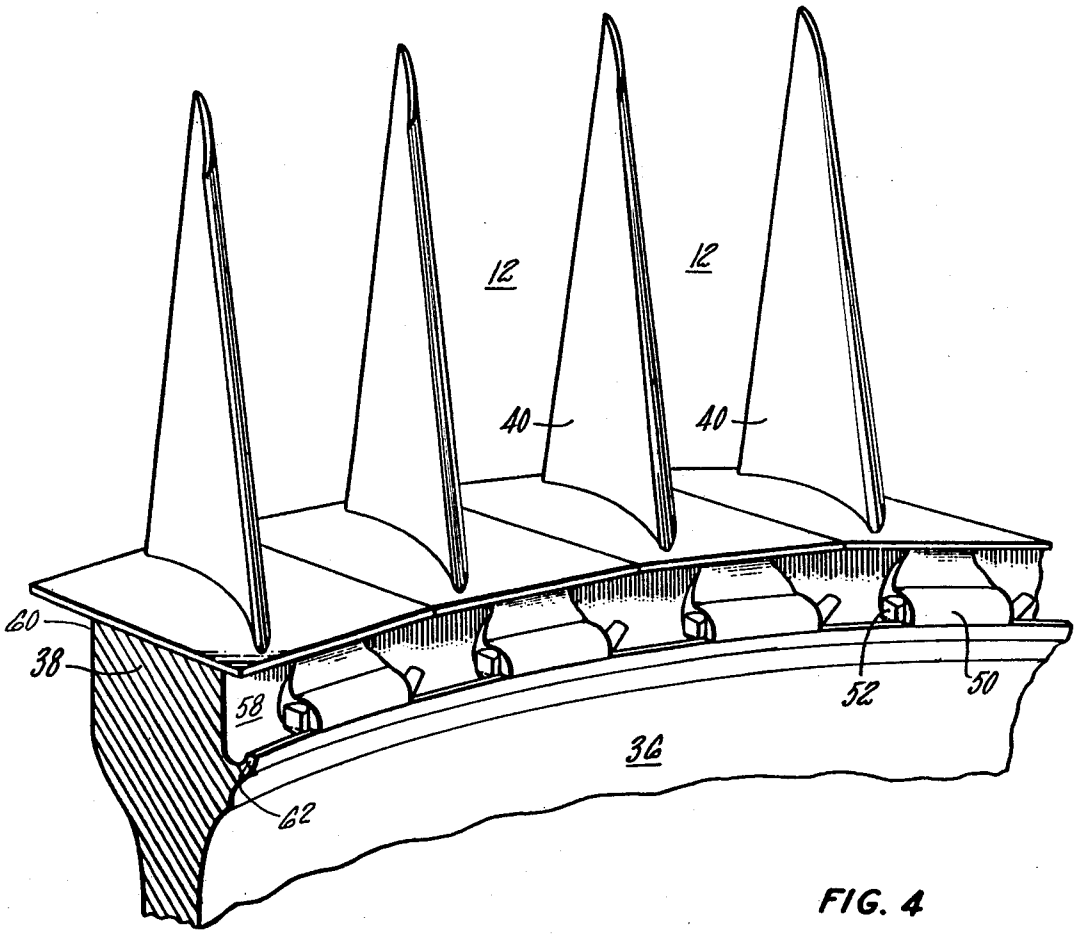
FIG. 4 is a partial perspective view of the rotor stage assembly of FIG. 3 in the assembled condition.

FIG. 4 is a partial perspective view of the rotor disk 36, the rotor blade 40 and the lock pins 52 in the assembled condition.

During assembly, each rotor blade 40 and a corresponding lock pin 52 are installed in the rim 38 of the disk 36. As shown in FIG. 3, a rotor blade is aligned for insertion in a corresponding blade attachment slot 42. After insertion of the blade, the lock pin 52 is slidable into engagement with the rotor blade and the disk to trap the blades on the disk. As shown in FIG. 2, this engagement is accomplished by sliding the lock pin 52*a* into the groove 44 of the disk and the groove 48 of the rotor blade. Until the lock pin is secured against lateral movement, the lock pin is slidable laterally along the groove 44 in the disk and the groove 48 in the blade to aid in the installation of adjacent lock pins as additional blades are installed in the disk.

As shown in FIG. 2 and FIG. 4, the lock pin is secured against lateral movement by bending the thinned end of the pin in the radial direction, preferably outwardly. In addition, the pins may be secured in place by welding or brazing.

During operation of the gas turbine engine, working medium gases are flowed through the compressor 10 along the flow path 12. As the gases pass through the compressor along the flow path, the gases tend to recirculate from the high pressure cavity 34 through the knife edge seals on the circumferentially extending shroud 30 to the low pressure cavity 32. This recirculating flow decreases the efficiency of the compressor. The radial projections 50 on the base of each rotor blade cause pumping of the working medium gases in a direction opposite to circulation of the recirculating flow, reducing the recirculating flow and decreasing the loss in compressor efficiency.

As the gases are pumped axially along flow path 12 through the rotor stage 20 of the compressor, the gases exert a force either in the upstream (fore) direction during normal operation or in the downstream (aft) direction such as might occur during surge. Each lock pin 52 engages both the blade and the disk such that movement of the blade in both the fore and aft direction is resisted by the shearing strength of the pin acting along a longitudinally oriented shear section such as a longitudinal plane or a lateral section in the pin. The pin 52 presents a larger shear area to shearing forces than do pins which resist fore and aft movement of the blade with a shearing force developed in the pin along a plane perpendicular to the lateral section. A smaller diameter pin 52 may be used to retain the blade against a given force as compared with these transverse shear pins reducing the weight of the assembly and aerodynamic losses associated with the means for retaining the pin.

Several advantages result from the specific location of the lock pin 52 with respect to the disk and the blade described. The pin engages the root of the blade and the disk at the base of the blade. The blade stresses are low in this region as compared with the stresses in the blade which result from engaging the blade radially outwardly of this point where the circumferential width of the blade is smaller than the base region. Moreover, as shown in FIG. 2, the scalloped pin acts to block the leakage of working medium gases through the blade attachment slot across the disk. In addition, the design permits accessibilty of the disk groove during fabrication to allow the edges of the disk to be finished to reduce the stress concentration at the edge of the blade attachment slot. During disassembly, the lock pin is removed by bending the thinned end of the pin in the radial direction and sliding the pin laterally out of the grooves 44,48. This permits disassembly of the single blade held in place by the pin.

As will be realized, the cross-sectional shape of the pin is circular as are the grooves which reduces the stress concentrations in the disk and the blade. Other cross-sectional shapes may be employed and are considered to be within the scope of this invention.

Although the invention has been shown and described with respect to preferred embodiments thereof, it should be understood by those skilled in the art that various changes and omissions in the form and detail thereof may be made therein without departing from the spirit and the scope of the invention.

I claim:

1. A rotor assembly of the type adapted for use in an axial flow rotary machine having a working medium flow path, the rotor assembly including a rotor disk having an upstream side facing in an upstream direction, a downstream side facing in a downstream direction, a plurality of blade attachment slots extending in a generally axial direction across the disk between the sides of the disk, and a projection on the disk extending from one of said sides which has a first groove extending in a lateral direction with respect to each attachment slot and facing in a generally outward direction, the rotor assembly further including a plurality of rotor blades, one blade extending from each of said attachments slots, each rotor blade having a root which engages the attachment slot, a base on said root and a second groove extending in a lateral direction with respect to the root in alignment with and facing said groove in the disk, and a pin engaging the rotor disk and the rotor blade at the first and second grooves respectively to trap the rotor blade in one direction on the disk, the improvement comprising:

a rotor disk having a first groove bounded by the projection and said side of the disk, the groove extending across each attachment slot;

a rotor blade having a second groove extending across the base of the blade;

a pin extending across said base and between said base and said disk to retain the rotor blade on the disk against movement in the upstream and downstream direction and to block the leakage of working medium gases through the attachment slot between the base of the blade and the attachment slot.

2. The rotor assembly of claim 1 wherein the base of each rotor blade has a radial projection which extends both radially and axially to bound the groove in the blade and which is adjacent to the working medium gases for pumping the working medium gases adjacent the rotor structure.

3. A rotor assembly of the type adapted for use in an axial flow rotary machine which has a working medium flow path having an upstream direction and a downstream direction, the rotor assembly further including a rotor disk having an upstream side, a downstream side, a plurality of blade attachment slots extending in a generally axial direction across the disk between the sides of the disk and having a corresponding plurality of rotor blades, one blade extending from each of said attachments slots, the improvements comprising:

a rotor disk having a first groove bounded by one of the sides of the disk extending in a lateral direction across each attachment slot and facing in a generally outward direction;

a rotor blade having a second groove extending in a lateral direction across the base of the blade in radial alignment with and facing said groove in the disk;

a pin engaging the rotor disk and the rotor blade at the first and second grooves respectively to restrain the rotor blade on the disk against movement in the upstream and downstream directions, the pin having a first end portion, a center portion and a thinned second end portion, the first end portion comprising a cylinder deformed into an L-shaped profile, the center portion comprising a right circular cylinder and the thinned end portion including a truncated right circular cylinder having a cross-sectional thickness which decreases constantly to the second end of the lock, the thinned end portion being bendable without fracture in a direction perpendicular to the longitudinal axis of the center section.

* * * * *